US008397400B2

(12) United States Patent
Choo et al.

(10) Patent No.: US 8,397,400 B2
(45) Date of Patent: Mar. 19, 2013

(54) HIGH TEMPERATURE LUMBER TREATMENT SYSTEM

(75) Inventors: Kheng Ten Choo, Seri Kembangan (MY); Huei Shing Sik, Kuala Lumpur (MY)

(73) Assignee: Forest Research Institute Malaysia (MY)

( * ) Notice: Subject to any disclaimer, the term of this patent is extended or adjusted under 35 U.S.C. 154(b) by 0 days.

(21) Appl. No.: 13/504,538

(22) PCT Filed: Nov. 23, 2010

(86) PCT No.: PCT/MY2010/000287

§ 371 (c)(1),
(2), (4) Date: Apr. 27, 2012

(87) PCT Pub. No.: WO2011/149327

PCT Pub. Date: Dec. 1, 2011

(65) Prior Publication Data

US 2012/0210595 A1 Aug. 23, 2012

(30) Foreign Application Priority Data

May 25, 2010 (MY) ..... 2010002410

(51) Int. Cl.
*F26B 7/00* (2006.01)

(52) U.S. Cl. ..... 34/396; 34/486; 414/198; 110/244; 427/441

(58) Field of Classification Search ..... 34/413, 34/417, 486, 396; 414/198; 110/243, 244, 110/251; 427/441; 44/500, 590, 609
See application file for complete search history.

(56) References Cited

U.S. PATENT DOCUMENTS

| | | | | | |
|---|---|---|---|---|---|
| 473,143 | A | * | 4/1892 | Coze | 414/199 |
| 1,578,020 | A | * | 3/1926 | Elmendorf | 34/389 |
| 1,785,571 | A | * | 12/1930 | Allen | 427/441 |
| 2,387,595 | A | * | 10/1945 | Krupnick et al. | 34/257 |
| 3,386,183 | A | * | 6/1968 | Reynolds | 34/549 |
| 3,744,144 | A | * | 7/1973 | Weis | 34/403 |
| 3,875,685 | A | | 4/1975 | Koch | |
| 3,986,268 | A | * | 10/1976 | Koppelman | 34/257 |
| 4,014,107 | A | * | 3/1977 | Bachrich | 34/191 |

(Continued)

FOREIGN PATENT DOCUMENTS

| | | | |
|---|---|---|---|
| EP | 122902 | A2 * | 10/1984 |
| GB | 2178149 | A * | 2/1987 |

(Continued)

*Primary Examiner* — Stephen M. Gravini
(74) *Attorney, Agent, or Firm* — Renner Kenner Greive Bobak Taylor Weber

(57) ABSTRACT

High-temperature method for the treatment of lumber, the method comprising the steps of providing stacks (10) of lumber, restraining those stacks, subjecting the stacks to a first conditioning phase, drying the stacks in an air stream at a temperature of not less than 120° C., cooling the stacks and subsequently subjecting the stacks to a second conditioning phase, and further cooling the dried stacks in ambient temperature air stream. A kiln for use in the high-temperature lumber treatment method of this invention, comprises a chamber (30) for receiving stacks of lumber, heat supply means to produce and supply heated air and steam for drying and conditioning the stacks, heat exchange means (35) to provide and maintain a stable and sustained temperature environment within the chamber, humidification means to provide and maintain a predetermined equilibrium moisture content within the chamber, air stream generation means (33, 34) to provide a sustained and uniform flow of air within the chamber, and control means for monitoring and controlling various drying parameters within the chamber.

21 Claims, 5 Drawing Sheets

U.S. PATENT DOCUMENTS

| | | | | | |
|---|---|---|---|---|---|
| 4,027,602 | A | * | 6/1977 | Mott | 110/203 |
| 4,058,906 | A | * | 11/1977 | Pagnozzi | 34/406 |
| 4,343,095 | A | * | 8/1982 | Rosen et al. | 34/411 |
| 4,893,415 | A | * | 1/1990 | Moldrup | 34/406 |
| 4,922,624 | A | * | 5/1990 | Tharpe | 34/475 |
| 5,195,251 | A | * | 3/1993 | Gyurcsek et al. | 34/489 |
| 5,228,209 | A | * | 7/1993 | Brunner | 34/417 |
| 5,408,942 | A | * | 4/1995 | Young | 110/243 |
| 5,970,624 | A | * | 10/1999 | Moriya | 34/411 |
| 5,992,048 | A | * | 11/1999 | DeVore et al. | 34/522 |
| 6,119,364 | A | * | 9/2000 | Elder | 34/212 |
| 6,138,379 | A | * | 10/2000 | DeVore et al. | 34/395 |
| 6,269,755 | B1 | * | 8/2001 | Boswell et al. | 110/264 |
| 6,345,450 | B1 | | 2/2002 | Elder | |
| 7,043,853 | B2 | * | 5/2006 | Roberts et al. | 34/73 |
| 7,963,048 | B2 | * | 6/2011 | Pollard | 34/396 |

FOREIGN PATENT DOCUMENTS

| | | | | |
|---|---|---|---|---|
| JP | 2000102907 | A | * | 4/2000 |
| WO | WO 8502250 | A1 | * | 5/1985 |
| WO | WO 9001664 | A1 | * | 2/1990 |
| WO | WO 2004070270 | A2 | * | 8/2004 |
| WO | WO 2010132970 | A1 | * | 11/2010 |

* cited by examiner

HIGH TEMPERATURE LUMBER TREATMENT SYSTEM

The invention relates to the treatment of lumber. More particularly, this invention is related to the high-temperature treatment of low or medium density hardwood.

DESCRIPTION OF THE PRIOR ART

Generally, wood needs to be treated prior to use, to increase its durability, particularly when used in the production of wood products such as furniture, flooring and cooking utensils. Wood may be treated either with chemicals and/or by heat (drying).

The European Union (EU) has recently called for certain wood treatment chemicals, particularly borates, to be assigned to the "Repro-toxic Category" under the Dangerous Substance Directive 67/548. Boric acid is the primary preservative used in the processing of rubberwood. In Malaysia, rubberwood is the major renewable plantation timber used in the manufacturing of high-end joinery and furniture for the export market. More than 80% of the wooden furniture exported from Malaysia is made of rubberwood. Hence, the EU's proposed categorization of wood treatment chemicals (e.g. borates), when implemented, will restrict the export of Malaysian rubberwood furniture.

As an alternative to chemical treatment, heat treatment can also be used to make timber more durable by drying it. The main reason for drying wood is to ensure that the wood is as dimensionally stable as possible before utilizing it in a structure or in downstream manufacturing such as furniture production. The drying process is seen as essential and of great importance for the economical utilization of wood in construction, wood-based manufacturing and craft applications.

Lumber may generally be categorized as hardwood (from non-monocotyledon angiosperm trees) or softwood (from conifer trees) type. Hardwoods have a more complex structure than softwoods, with the main distinguishing feature being the presence of pores, or vessels within the wood body. Hence, heat treatment or drying of hardwood lumber necessitates more accurate control of temperature and humidity than drying of softwood lumber i.e. drying kilns of significantly different designs. Rubberwood is classified under the light hardwood category.

To date, more than 95% of lumber drying mills in Malaysia utilize a conventional low temperature steam-heated drying system. These prior dry kilns are enclosed chambers in which the condition of the drying medium, in this case air, may be controlled in terms of temperature, humidity and air circulation to accelerate or retard the drying process, as required.

However, there are several distinct disadvantages of such low temperature conventional drying methods, for example, significantly long process time, e.g. drying of rubberwood with conventional drying methods requires a total period of 10 to 12 days, and inefficient use of energy, e.g. conventional drying methods require 2 to 4 times the minimum energy necessary to evaporate water. For example, GB patent no. 1,142,525 discloses a method of drying hardwood in a kiln including steps of steaming and water spraying at temperatures of between 21° C. to 66° C. (70° F. to 150° F.). This prior drying method takes 14 days to complete.

Generally, kiln drying time can be accelerated in one of two ways, either by drying at significantly higher temperatures or under partial vacuum conditions.

The Rosen method disclosed in U.S. Pat. No. 4,343,095 is directed at drying of wood at super-atmospheric pressures of between 103.4 kPa and 344.7 kPa (15 and 50 psi) and temperatures of between 100° C. and 177° C. (212° F. and 350° F.). A specialized cylindrical kiln is needed in order to perform this drying method. One drawback of the prior drying method of this US patent, would be the high costs involved in building and maintaining such a kiln. It has also been mentioned by Kollmann and Cote (1984) (Kollmann, F. F. P & Cote, Jr., W. A. 1984*: Principles of Wood Science and Technology-Volume I: Solid Wood*. Berlin: Springer-Verlag) that such high temperature heating generally results in drawbacks such as exudation of resin, loosening of knots, relatively steep moisture gradient and early deterioration of the kiln structure.

Commercial high-temperature drying methods of light hardwood such as rubberwood and/or other tropical hardwoods are a nonentity. However, rubberwood has a notable tendency to warp during treatment, which can be kept under control (mostly) by applying pressure during drying.

U.S. Pat. No. 2,268,477 discloses a prior method of drying hardwood under restraint against shrinkage across the width of the board or sheet. However, the restraint protocol and drying method of this US patent resulted in visible defects on the surface of the treated wood e.g. dark areas where wood has been reduced in thickness due to partial hydrolysis of cellulosic components. The density of these dark hydrolyzed areas exceeds that of normal wood, but instead of becoming harder, the wood becomes brittle.

Thus, an effective high-temperature drying protocol needs to be developed for a high throughput of quality dried lumber derived from lower to medium density range tropical hardwood (e.g. rubberwood).

This invention thus aims to alleviate some or all of the problems of the prior art.

SUMMARY OF THE INVENTION

In accordance with an aspect of the invention, there is provided a high-temperature method for the treatment of lumber.

The method comprises the steps of:

(i) providing stacks of lumber;
(ii) restraining the stacks;
(iii) subjecting the stacks to a first conditioning phase;
(iv) drying the stacks in an air stream at a temperature of not less than 120° C.;
(v) cooling the stacks and subsequently subjecting the stacks to a second conditioning phase; and
(vi) further cooling the dried stacks in ambient temperature air stream.

In an embodiment of the invention, the stacks may comprise freshly sawn lumber. Each of the stacks may comprise lumber of even thickness from end to end and crosswise between individual pieces of lumber in each stack.

In another embodiment, step (ii) may comprise applying a load restraint over each stack. An evenly distributed load restraint of not less than 700 kg/m$^2$ may be applied over each stack.

In a further embodiment, step (iii) may comprise a saturated steam environment of not less than 95° C. The stacks may be subjected to step (iii) for between 6 to 12 hours.

According to another embodiment, the air stream of step (iv) may have an average velocity of between 2.5 to 3.5 ms$^{-1}$. Step (iv) may be conducted at a temperature of not less than 120° C. and up to 200° C. The stacks may be dried in step (iv) to a dry bulb temperature of not less than 120° C. and a wet bulb temperature of not less than 70° C.

According to a further embodiment, step (v) may comprise lowering the temperature of the dried stacks sufficiently so that the lumber can be effectively conditioned when subsequently subjected to the second conditioning phase. The stacks may be cooled to a lumber surface temperature of between about 80° C. to about 90° C., prior to being subjected to the second conditioning phase. The cooled dried stacks may be subjected to a second conditioning phase in step (v) for about 6 to 12 hours. The stacks may be conditioned at a wet bulb depression of about 20° C.

In an embodiment, the stacks may be further cooled in step (vi) for a period of not less than 12 hours.

Lumber treated with the method of this invention may have an average moisture content of 4% to 6%.

Lumber treated with the method of this invention may be of the hardwood type, or more particularly, a low to medium density hardwood.

According to a second aspect of the invention there is provided a kiln adapted for use in the high-temperature lumber treatment method of this invention. The kiln comprises a chamber for receiving stacks of lumber, heat supply means to produce and supply heated air and steam to the chamber for drying and conditioning the lumber stacks, heat exchange means to provide and maintain a stable and sustained temperature environment within the chamber suitable for drying and conditioning the lumber stacks, humidification means to provide and maintain a predetermined equilibrium moisture content within the chamber, air stream generation means to provide a sustained and uniform flow of air within the chamber, and control means operatively connected to the heat supply means, heat exchange means, humidification means and air stream generation means for monitoring and controlling drying parameters within the chamber.

In an embodiment of this aspect, the chamber may comprise walls made of block panels that enable efficient heat insulation and allows for insertion of reinforcement means. The insulator block panels may comprise light weight fire retardant panels.

In another embodiment of this aspect, the heat supply means may comprise a boiler.

According to yet another embodiment of this aspect, the heat exchange means may comprise flat panel stainless steel finned heat exchangers or extruded aluminum fins on carbon steel.

In a further embodiment of this aspect, the kiln may further comprise ventilation means that operatively functions with the humidification means to achieve the required air condition within the chamber. The ventilation means may comprise a series of paired inlet and outlet vents located on top or at the sides of the chamber.

In yet another embodiment of this aspect, the air stream generation means may comprise a motor and fan assembly, the motor being located inside or outside the chamber, and the fan being located in the upper portion of the chamber. The motor and fan assembly may enable generation of an air stream having an average velocity of between about 2.5 to about 3.5 $ms^{-1}$.

According to an embodiment of this aspect, the control means may comprise a set of industrial programmable logic controller (PLC) instrumentation.

In an embodiment of this aspect, the kiln may further comprise an integral conditioning chamber for optionally receiving the stacks of step (iv) and subsequently hosting steps (v) and (vi) of the method of this invention to enable shortened kiln chamber residence time so as to minimize inherent build-up of internal stress within the lumber. The conditioning chamber may be of identical technical specifications as the kiln chamber.

It is an object of the invention to seek to mitigate the disadvantages of the prior art wood treatment systems, or at least to provide the public with a fast, economical and energy efficient choice. The high-heat treatment method and kiln of this invention, intended for use in the drying-cum-heat treatment of tropical hardwood dimension stocks intended for the manufacture of wooden furniture and components, eliminates the need for chemical preservatives and significantly shortens lumber treatment time.

BRIEF DESCRIPTION OF THE DRAWINGS

This invention will now be further described by way of non-limitative examples, with reference to the accompanying drawings, in which.

DEFINITIONS

Figure 1:
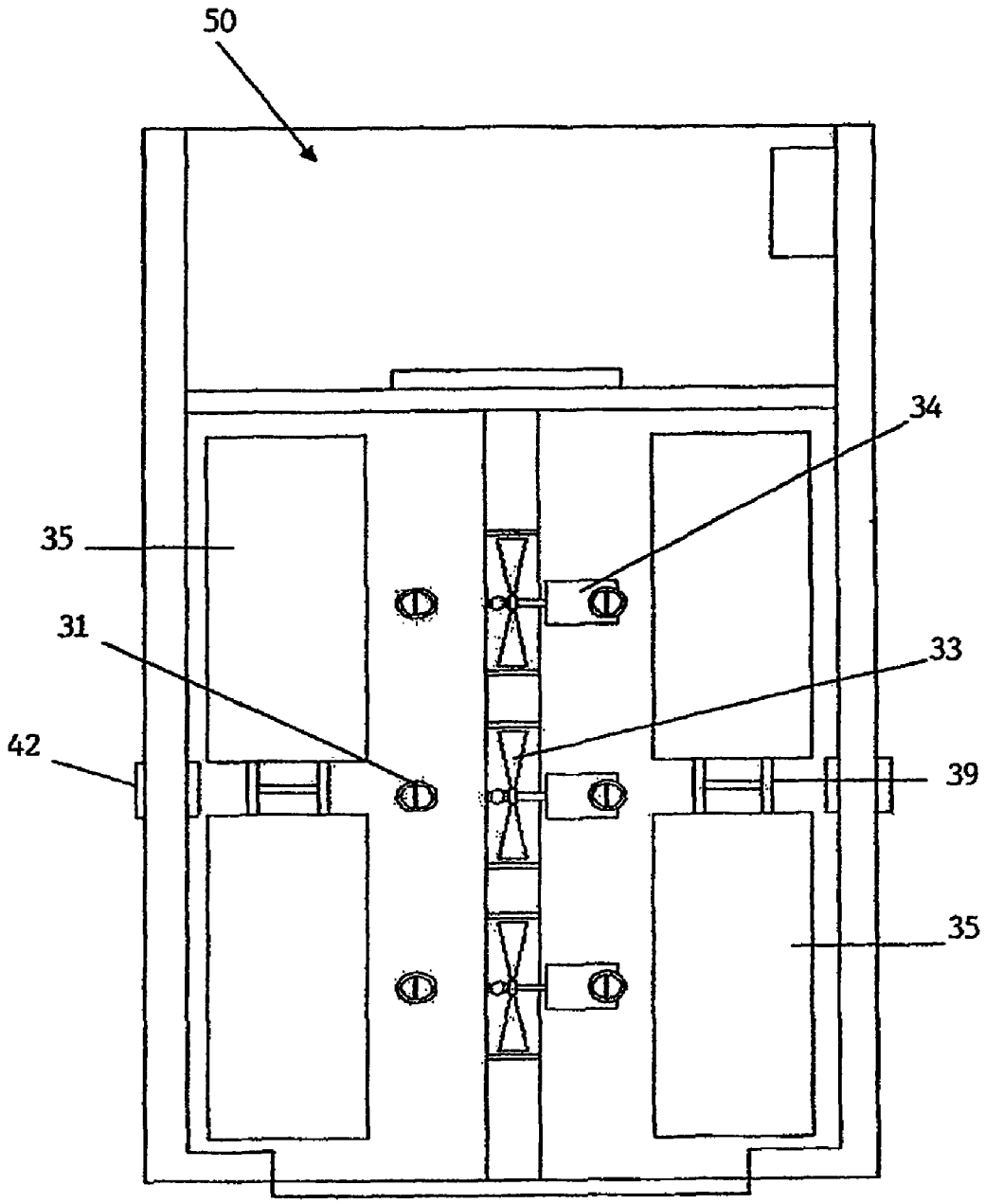
FIG. 1 is a plan view of a kiln for carrying out a treatment method according to the invention.

Unless otherwise defined the following terms as used throughout this specification are defined as follows:

"Dry bulb temperature (DBT)" as used herein refers to the temperature measured by a thermometer freely exposed to air but shielded from radiation and moisture.

"Equilibrium moisture content or EMC" (Siau, 1984) as used herein refers to the wood condition when the amount of moisture remaining in the wood is in equilibrium with the water vapour pressure in the ambient space.

"Wet bulb temperature (WBT)" as used herein refers to the temperature measurement that reflects the physical properties of a system with a mixture of air and water vapor.

"Stickers" as used herein refers to thin transverse slats of wood used to space apart layers of lumber within a lumber stack so as to form air passages in the stack.

DESCRIPTION OF THE PREFERRED EMBODIMENTS

Referring to the drawings, a high-temperature method for the treatment of lumber is provided and also a kiln for use in the treatment is provided as follows.

High-temperature Lumber Treatment Method

A high-temperature treatment method for the treatment of lumber according to the present invention heats and dries lumber using staged air-steam mixtures at dry-bulb temperatures (DBT) of not less than 120° C. Existing conventional kiln systems involve drying of tropical hardwood lumber (e.g. rubberwood) at temperatures not exceeding 75° C.

The treatment method of the invention generally involves four main stages, namely, pre-treatment preparation phase, plasticization phase (first conditioning phase), drying phase and final conditioning phase.

Pre-treatment Preparation Phase

The use of air-dried lumber is preferably avoided in the treatment method of this invention. Use of freshly sawn lumber is preferred.

The kiln load or lumber stacks 10 are constructed in the open area adjacent the drying kiln. Completed or partially built-up stickered stacks of lumber 10 (kiln load) should be kept very near to freshly cut green moisture content.

Figure 4:
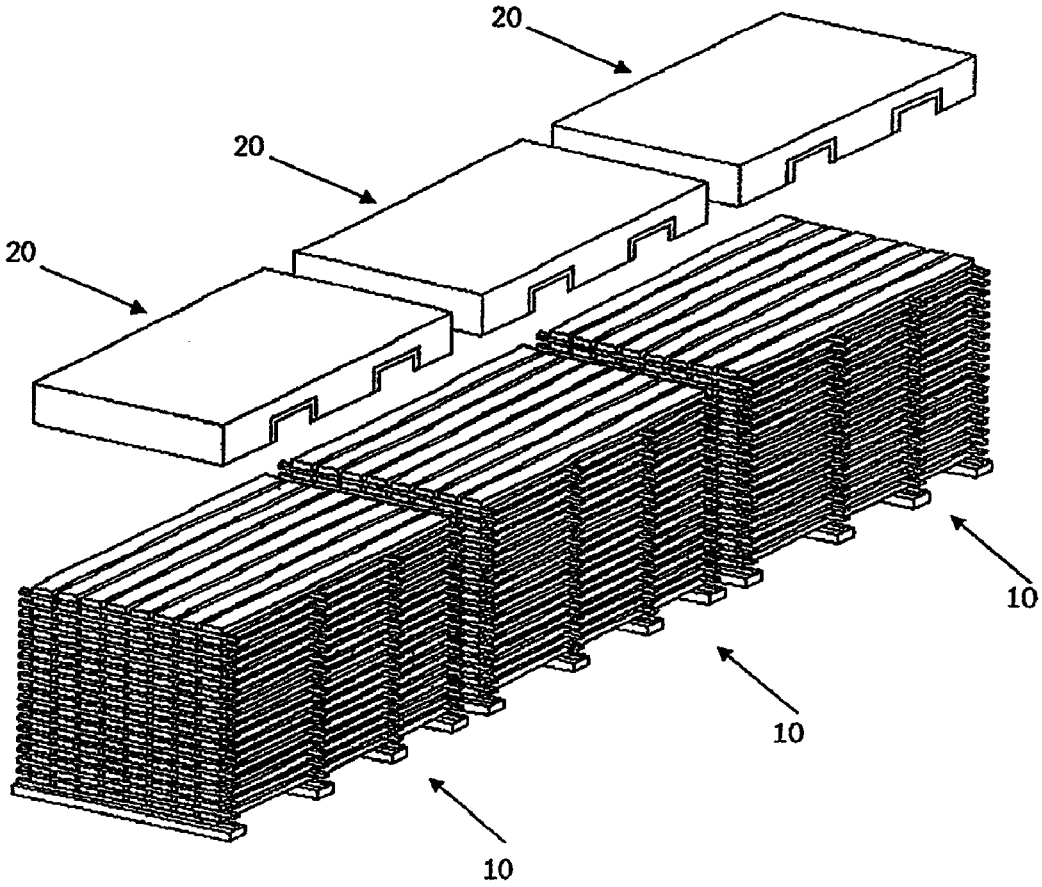
FIG. 4 shows application of the load restraint to lumber stacks, according to the treatment method of this invention.
Figure 5A:
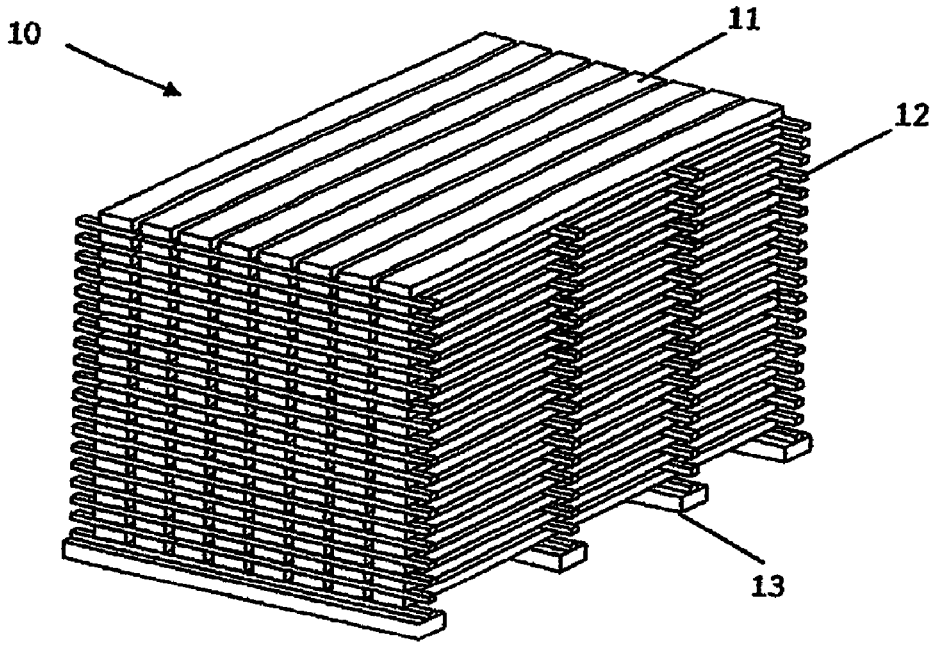
FIG. 5A shows the lumber stacks of FIG. 4, prior to application of load restraint.

It is preferable that all individual stacks 10 of lumber for use in the treatment method of this invention are to be constructed in a stickered-stack configuration, as seen in FIGS. 4 and 5A. The outermost lumber pieces 11 of each stack layer should be vertically aligned. Stickers 12 of uniform cross-section (e.g. of 25 mm×25 mm cross-section) are vertically aligned and spaced apart from each other. Preferably, the stickers 12 are spaced apart by not more than 300 mm. Well constructed lumber stacks 10 with the above described configuration of stickers, aid in ensuring even application of heat and moisture during the subsequent treatment phases of the method. Bearers or bolsters 13 of larger cross section than stickers 12 are provided at the bottom of the lumber stacks 10 to facilitate access by fork lift tines.

Further, each of the stacks 10 should preferably comprise lumber 11 of even thickness from end to end and crosswise between individual pieces of lumber in each stack. Most preferably, the thickness of the green sawn lumber material should not vary by more than 2 mm from end to end or crosswise between individual pieces 11. In a preferred embodiment of the method of this invention, the individual lumber stacks 10 should measure approximately 1.2 m (w)× 1.2 m (h)×2.0 m (l), eventually making a total stack volume of approximately 17 cubic meters (15 cubic tons) per chamber.

Upon construction of the lumber stacks (kiln load) 10, an evenly distributed load restraint 20 is applied over the entire top horizontal area of each stack 10 (FIG. 4). Well constructed stickered stacks 10 of lumber aid in ensuring even and adequate application of load restraint on all individual lumber pieces 11. It is preferable that the load restraint 20 applied be not less than 700 kg/m$^2$, and most preferably be between 700 kg/m$^2$ and 900 kg/m$^2$. Insufficient loading may lead to poor recovery of heat treated lumber. The load restraint force is generally dependent on the thickness of each piece of lumber 11 per lumber stack 10.

Figure 5B:
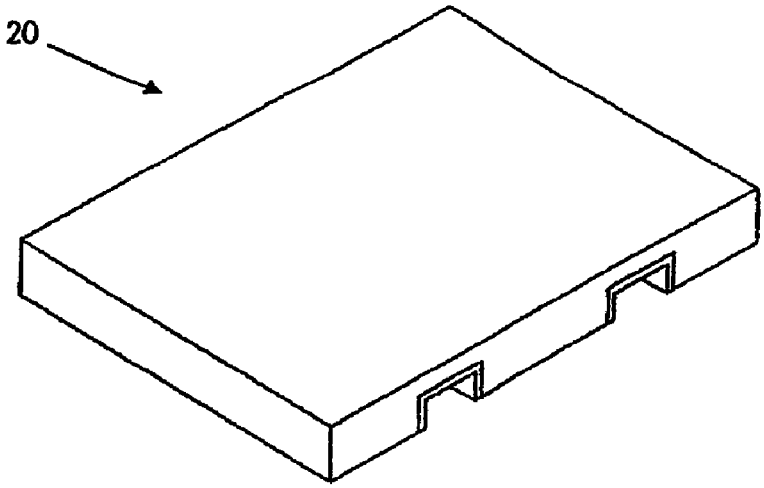
FIG. 5B shows the load restraint of FIG. 4.

The physical load restraint 20 may comprise any form of weights, preferably, having a load force of not less than 700 kg/m$^2$. Preferably, the load restraint used in the method of this invention consists of reinforced concrete slabs 20 placed just above the top most part of the kiln load (lumber stack) 10, as seen in FIGS. 4 and 5B.

This load restraint 20 should be maintained continuously throughout the treatment method until completion to ensure high quality throughput of the lumber batches. This physical load restraint has a significant effect on the reduction of warping (and its magnitude), leading to better recovery.

Plasticization (First Conditioning) Phase

This is the first treatment phase conducted within the kiln. More particularly, this plasticization or first conditioning phase is conducted in the main chamber 30 of the kiln.

The restrained lumber stacks 10 are subjected to steam for a minimum of 6 to 12 hours in a saturated condition of not less than 95° C., and most preferably between 95° C. to 100° C.

Any unintentional cooling of the lumber stacks 10 during this phase will reduce the effectiveness of the applied load restraint 20.

Drying Phase

The conditioned lumber stacks 10 are then dried in the main chamber 30 (drying chamber) of the kiln with the protocol below:

(i) dry bulb temperature of not less than 120° C. and up to 200° C.; and (ii) wet bulb temperature of not less than 70° C.

Most preferably, the dry bulb temperature of the lumber stacks 10 should be not less than 120° C. to 160° C., and the wet bulb temperature should be not less than 70° C. to 80° C.

In a preferred embodiment of the treatment method of this invention, the lumber stacks 10 are dried in an air stream having an average air velocity through the stacks 10 of 2.5 to 3.5 ms$^{-1}$ (average of the air velocity readings taken at the "air exhaust" side of the lumber stacks 10 e.g. top, middle and bottom spaces between stack layers, and at intervals along the length of lumber stack 10). This average air velocity reading may be measured using a hot-wire anemometer or any other suitable instrument.

Following this drying phase, it is targeted for the dried lumber stacks 10 to have an average equilibrium moisture content of about 4% to 6%.

Final Conditioning Phase

At the end of the drying phase, significant difference (dispersion) in moisture content normally occurs between lumber pieces 11, both along the length and within the cross-section of individual pieces 11. These differences and any internal stresses formed are relieved by further conditioning the lumber stacks 10.

Prior to final conditioning, the temperature of the lumber surface must be lowered to around 80° C. to 90° C. so that the steam will be able to effectively wet the lumber pieces 11 as intended, instead of flashing off.

The final conditioning phase runs for about 6 to 12 hours in a separate conditioning chamber (not shown) where the stacks are conditioned at a wet bulb depression of about 20° C.

After conditioning, the lumber stacks 10 are allowed to cool in an ambient temperature air stream for not less than 12 hours before discharging.

Kiln for Use in the High-temperature Lumber Treatment Method

Figure 2:
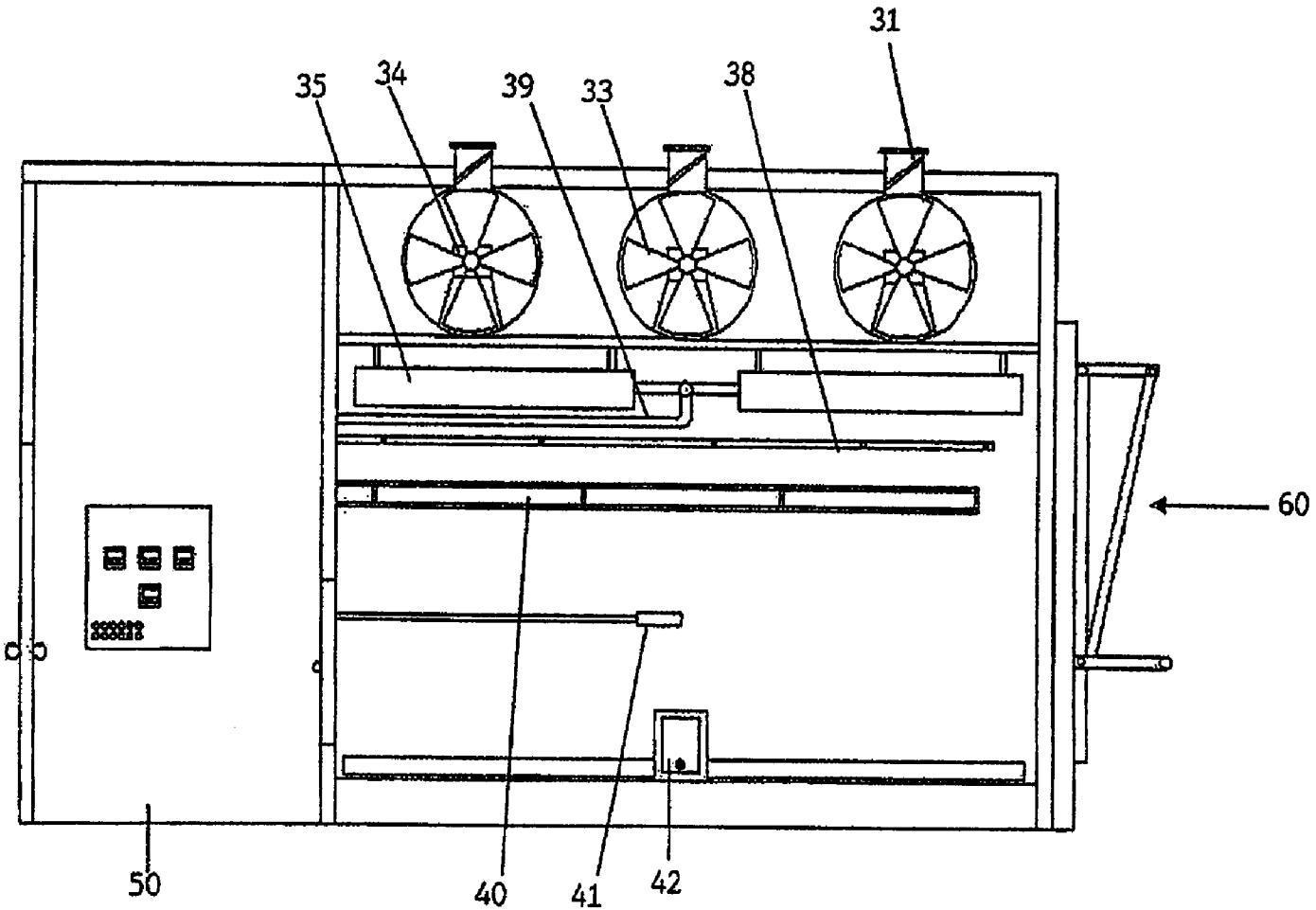
FIG. 2 is a side view of the kiln of FIG. 1.
Figure 3:
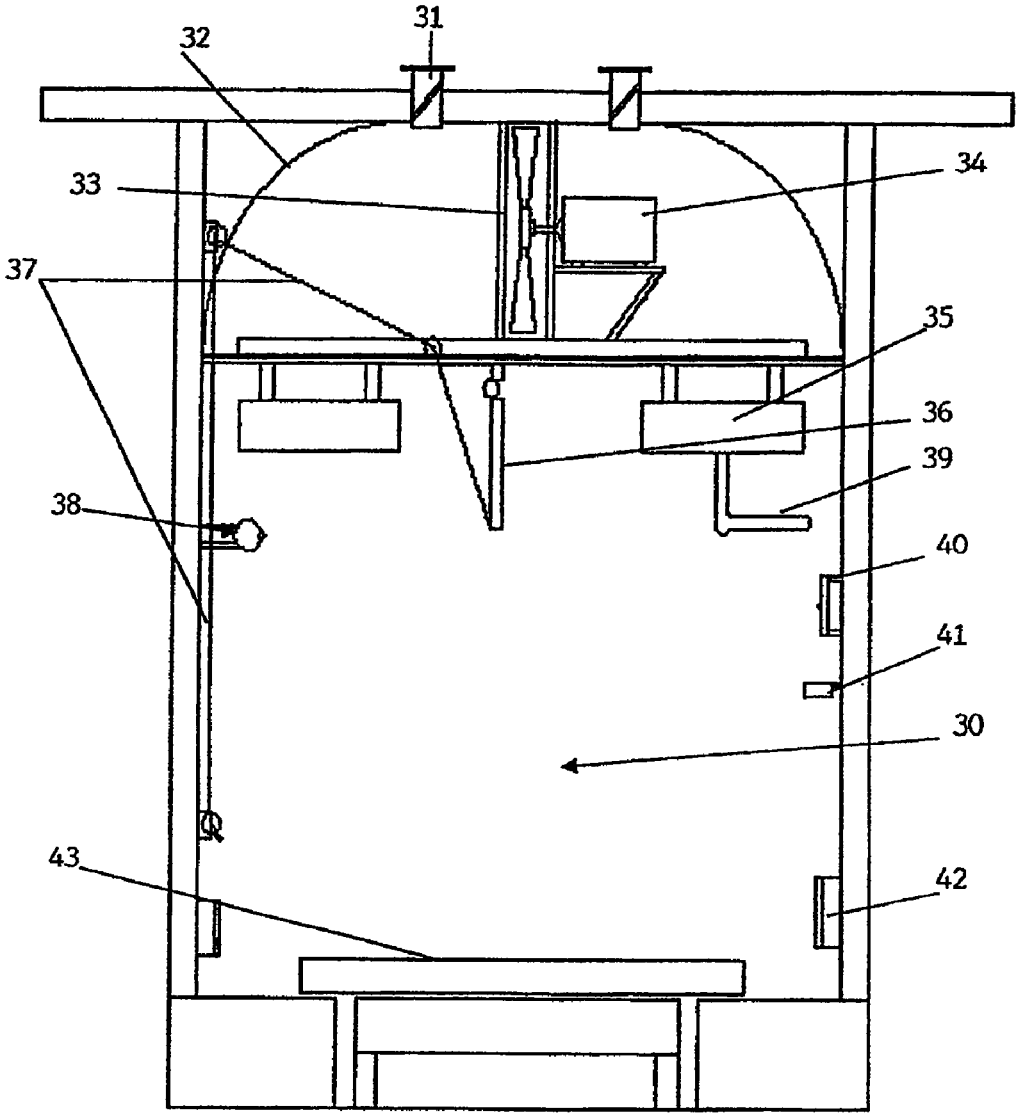
FIG. 3 is a front view of the kiln of FIG. 1.

FIGS. 1 to 3 show an embodiment of a kiln adapted for use in the high-temperature lumber treatment method according to the present invention. This kiln is an enclosed structure comprising a chamber 30 for receiving stacks of lumber 10, heat supply means to produce and supply heated air and steam to the chamber 30, heat exchange means to provide and maintain a stable and sustained temperature environment within the chamber 30, humidification means to provide and maintain a predetermined equilibrium moisture content within the chamber 30, air stream generation means to provide a sustained and uniform flow of air within the chamber 30, and control means for monitoring and controlling various drying parameters within the chamber 30.

The enclosed structure of the kiln defines an opening leading to the kiln main chamber 30 sized to allow passage of lumber stacks 10 into the chamber 30 for drying and subsequently to allow discharge of the stacks 10. A main access door 60 constructed of the same material as the basic structure of the chamber 30 is fitted across the opening. The door 60 may be operated by any suitable system, and preferably, by an overhead rail mounted door carrier. Of course, provision of additional doors (numbers as appropriate) is also envisioned.

The kiln main chamber 30 has a reinforced concrete slab foundation and walls comprising block panels that enable heat insulation. Preferably, the main chamber walls comprise proprietary block panels i.e. light weight fire retardant insulated block panels provided with vertical core holes to allow for insertion of reinforcement for possible formation of a column and beam structure. Usage of the block panels enables the main chamber to be very energy efficient as these panels are approximately 10 times more resistant to heat transmission than a double brick wall. When affixed onto the reinforced concrete slab foundation, use of these panels provides sufficient stiffness such that chamber wall deformation is limited.

The main chamber 30 is also provided with a handling line 43 comprising a platform trolley for receiving the lumber stacks 10. Lumber stacks 10 are forklift-loaded onto the trolley 43 outside of the kiln and subsequently, transported into the main chamber 30 of the kiln. The area in front of the kiln is concreted to allow for unobstructed and safe movement of forklift trucks.

The main chamber 30 is provided with a false ceiling and the portion above this false ceiling (chamber upper portion) houses the air flow generation means. Any form of suitable air flow generation means capable of generating a uniform cross-flow of forced air circulating at a speed of about 2.5 to 3.5 $ms^{-1}$, may be used. Preferably, a class H insulation motor 34 and fan 33 assembly is used. The motor 34 may be located inside or outside the main chamber 30, while the fan 33 and housing are located in the chamber upper portion. Multiple motor-fan assemblies 34, 33 are preferable, e.g. three assemblies. Assemblies that provide reversible air flow are envisioned. Air flow deflectors or directors 32 are also provided within the chamber upper portion, adjacent the fan assemblies 33, for lateral redirection of air flow.

Heated air and steam are supplied to the main chamber 30 by a boiler of conventional design (not shown). In addition to conventional fuel sources, wood residues may also be used as boiler fuel for the generation of steam and heated air up to about 200° C. necessary for the drying phase of the treatment method.

Heat generated by the boiler is fed into the main chamber 30 by way of heat exchange means 35. Any suitable heat exchange means 35 may be used in the kiln of this invention. Flat panel stainless steel finned heat exchangers or extruded aluminum fins on carbon steel heat exchangers are preferred. These heat exchangers 35 are highly efficient and capable of providing stable and sustained dry-bulb temperatures of up to 200° C. inside the main chamber 30 at very fast heat exchange rates that can be maintained throughout chamber operation. The heat exchange panels 35 are mounted to the main chamber false ceiling (below the motor-fan assemblies at two sides of the main chamber 30) and extend along the length of the chamber 30. A circuit of heating pipelines 39 connects the heating panels 35 to the boiler.

Humidification means, essential for achieving the pre-determined kiln Equilibrium Moisture Content (EMC) condition, comprises water (ambient temperature) and steam spray systems 38 operatively connected to the heat exchange means (heating panels 35). Humidification is needed for the conditioning phases (first and final phases) of the high-temperature lumber treatment method of this invention in order to enhance lumber grain features. The water and steam spray system (lines) 38 are provided below the heating panels 35.

A de-superheater assembly 40 operatively connected to the boiler and heating panels 35 is provided below the water and steam spray system 38 for cooling of superheated steam.

Ventilation means comprising series of paired pneumatic actuated vents 31 (inlet and outlet vents) is provided on top or at the sides of the main chamber 30. Together with the above-mentioned humidification system, the ventilation means enables the required drying air condition (e.g. temperature, humidity etc.) in the main chamber 30 to be achieved.

Further, a baffle plate 36 hinged to the ceiling of the main chamber 30 is also provided to aid in encouraging and controlling airflow across the top board layer of the lumber stacks 10. The baffle plate 36 is pivotably operated by way of a chain pulley system 37. It can be pivoted up to a position clear of an incoming charge of lumber, and once the charge is positioned, it can be lowered.

A partitioned control room 50 adjacent the main chamber 30 that houses the control means needed to obtain and maintain an optimized drying rate critical for quality throughput of lumber stock, is also provided within the kiln structure. The control means is operatively connected to the heat supply means, heat exchange means, humidification means and air stream generation means for monitoring and controlling various drying parameters within the main chamber 30. Any suitable control means may be used.

Preferably, a set of industrial programmable logic controller instrumentation (PLC) operating together with the required sensors is used. Dry-and-wet bulb temperature sensors 41 are provided within the main chamber, below the de-superheater assembly 40. The control of dry-and-wet bulb temperatures and drying parameters are done via various pneumatic actuated regulator valves 42 (e.g. pressure equalization valves) cum positioners.

In a preferred embodiment of the kiln of this invention, a conditioning chamber (separate from the main chamber 30) having identical technical specifications (similar built-in peripherals) as that of the main chamber 30, is provided. This conditioning chamber is critical in aiding to minimize the inherent build-up of internal stresses within the lumber during the treatment method. A low internal stress in processed lumber is a pre-requisite feature for wooden furniture and components fabrication.

The conditioning chamber is a time saving feature as it may optionally receive the dried lumber stacks 10 (after drying phase) and subsequently host the final conditioning phase (moisture equalization) of the treatment method so as to enable shortened kiln chamber residence time, which minimizes inherent build-up of internal stress within the lumber. A shortened kiln residence time also enables reduced lapse time in loading of fresh charge i.e. increased kiln productivity.

High-temperature Lumber Treatment Kiln Capacity

It is generally estimated that in a typical rubberwood furniture plant, about 70% of the sawn lumber requirement will be for material of 30 mm thickness with the remainder possibly consisting of stock sizes up to 50 mm. Sawn rubberwood of 30 mm thickness, for example, requires about 10 to 12 days to achieve an equilibrium moisture content of approximately 10% when dried in a conventional kiln. Lumber material of the same thickness would require less than 2 days of kiln residence time with the high-temperature treatment method and kiln of this invention.

In a hypothetical scenario, a company has a projected monthly requirement of about 453 cubic meters (400 cubic tons) of rubberwood, thus the total required kiln chamber capacity is estimated at 453 cubic meters (400 cubic tons) with an allowance for excess capacity of about 10%. Based on the respective values mentioned, a conventional kiln chamber can accommodate approximately 2.5 lumber charges, of 30 mm thickness per month and about 6 units of 34 cubic meters (30 cubic tons) kilns are required.

For the method and kiln of this invention, only 2 units of 17 cubic meters (15 cubic tons) kilns will be needed to achieve the same production capacity.

Rubberwood is naturally susceptible to fungal discolouration and insect infestation. The prevalent industrial practice to minimize such degradations is to chemically treat the wood immediately upon conversion from logs followed by subsequent kiln drying. The selection of a kiln chamber of appropriate capacity is a major factor to consider in the production of kiln dried rubberwood dimension stocks. Henceforth, a battery of smaller capacity kiln chambers is optimal as it allows fast loading and early commencement of the drying process as well as better control of the drying parameters.

In a preferred embodiment, the kiln of this invention would comprise 2 kiln chambers, each with a capacity of approximately 17 cubic meters (15 cubic tons) per charge, amounting to a total monthly throughput of 510 cubic meters (450 cubic tons). The approximate dimension of each chamber is 4.9 m (w)×8.5 m (l)×4.3 m (h) [16'(w)×28'(l)×14'(h)].

Observations

It has been observed that rubberwood requires less than 25% drying time with a method and kiln of this invention in comparison to a conventional kiln drying method.

Further, the quality of lumber produced with the method and kiln of this invention is generally good and has better dimensional stability when compared to lumber produced by conventional methods. Some of the improved lumber attributes resulting from the method of this invention are as discussed below.

(a) Reduced Negative Impact On The Environment

The method of this invention eliminates the need to use chemical preservatives in the treatment of rubberwood, currently the major renewable plantation timber for manufacturing of high-class joinery and furniture for export markets, in Malaysia. Rubberwood is sustainably produced from plantations and is a viable substitute for the depleting wood supply from natural forests.

The method of this invention also offers an alternative solution on countering the threat of the EU ban on borates, the main chemical preservative commonly used in rubberwood processing. Essentially, in the method of this invention, high-heat exposure is used to fumigate the lumber against insect attacks.

(b) Energy-efficient System

The sustained high-temperature feature of the treatment method and kiln of this invention, provided by an energy-efficient system, enables a high-throughput of dried lumber e.g. 30 mm×105 mm dimension stocks suitable for wood based furniture industry. The treatment time for 30 mm-thick sawn dimension stocks is reduced to about 2 days in comparison to a total period of 10 to 12 days required by conventional drying methods.

(c) Cost-efficient Operation

A techno-economic study has been carried out to assess and compare the cost-effective attributes of building a new conventional steam-heated kiln and a high-temperature treatment method kiln (taking into consideration a complete drying facility equipped with boiler and water supply system). The study shows that a complete high-temperature treatment kiln can be set up with comparatively less capital investment than that required for setting up a conventional drying kiln. The comparison was made based on the same overall production capacity for both types of kilns.

(d) Enhanced Timber Quality

The high-temperature treatment method of this invention minimizes warping of lumber. The physical load restraint used when preparing the lumber stacks for treatment maintains the straight-formed sawn lumber with minimum warping.

The lumber treated with the method of this invention has enhanced grain features and improved color uniformity. The exposure to high heat treatment plus the application of specific high humidity enhances the appearance of the wood grain and produces a more uniform, albeit darker color, throughout the lumber.

Lumber processed with the method of this invention also has inherently lower equilibrium moisture content (EMC) and is less prone to movement (shrinking or swelling due to fluctuating ambient moisture) i.e. has increased dimensional stability. The rubberwood dried with the high temperature method of this invention equilibrated at 1 to 2% lower at given EMC conditions (from 8 to 20% EMC) than conventional temperature dried rubberwood.

As will be readily apparent to those skilled in the art, the present invention may easily be produced in other specific forms without departing from its scope or essential characteristics. The present embodiments are, therefore, to be considered as merely illustrative and not restrictive, the scope of the invention being indicated by the claim rather than the foregoing description, and all changes therefore are intended to be embraced therein.

The invention claimed is:

1. A high-temperature method for the treatment of lumber, said method comprising the steps of:

(i) providing stacks of lumber;

(ii) applying a load restraint over each stack to restrain said stacks;

(iii) subjecting said stacks to a first conditioning phase;

(iv) drying said stacks in an air stream at a temperature of not less than 120° C.;

(v) cooling said stacks and subsequently subjecting said stacks to a second conditioning phase; and (vi) further cooling said dried stacks in ambient temperature air stream.

2. The method as claimed in claim 1 wherein said stacks comprises freshly sawn lumber.

3. The method as claimed in claim 1, wherein each of said stacks comprises lumber of even thickness from end to end and crosswise between individual pieces of lumber in each stack.

4. The method as claimed in claim 1 wherein step (ii) comprises applying an evenly distributed load restraint of not less than 700 kg/m$^2$ over each stack.

5. The method as claimed in claim 1 wherein said stacks are subjected to said first conditioning phase of step (iii) comprising a saturated steam environment of not less than 95° C., for between 6 to 12 hours.

6. The method as claimed in claim 1 wherein step (iv) is conducted at a temperature of not less than 120° C. and up to 200° C. and said air stream has an average velocity of between 2.5 to 3.5 ms$^{-1}$.

7. The method as claimed in claim 1 wherein said stacks are dried in step (iv) to a dry bulb temperature of not less than 120° C. and a wet bulb temperature of not less than 70° C.

8. The method as claimed in claim 1 wherein step (v) comprises lowering the temperature of said dried stacks sufficiently so that the lumber can be effectively conditioned when subsequently subjected to the second conditioning phase.

9. The method as claimed in claim 8 wherein said dried stacks are cooled to a lumber surface temperature of between about 80° C. to about 90° C., prior to being subjected to the second conditioning phase.

10. The method as claimed in claim 1 wherein said cooled dried stacks are subjected to a second conditioning phase in step (v) for about 6 to 12 hours at a wet bulb depression of about 20° C.

11. The method as claimed in claim 1 wherein said stacks are further cooled in step (vi) for a period of not less than 12 hours.

12. A kiln adapted for use in the high-temperature lumber treatment method of claim 1, said kiln comprising:

a main chamber for receiving stacks of lumber;

a heat supply to produce and supply heated air and steam to said main chamber, for drying and conditioning said lumber stacks;

a heat exchanger to provide and maintain a stable and sustained temperature environment within said main chamber suitable for drying and conditioning said lumber stacks;

a humidifier to provide and maintain a predetermined equilibrium moisture content within said main chamber;

an air stream generator to provide a sustained and uniform flow of air within said main chamber; and a controller operatively connected to the heat supply, the heat exchanger, the humidifier and the air stream generator for monitoring and controlling drying parameters within said main chamber;

wherein the kiln further comprises an integral conditioning chamber separate from the main chamber for optionally receiving said dried lumber stacks of step (iv) of claim 1 and for subsequently hosting steps (v) and (iv) of the method of claim 1, to enable shortened kiln chamber residence time so as to minimize inherent build-up of internal stress within the lumber.

13. The kiln as claimed in claim 12 wherein said main chamber comprises walls made of block panels that enable efficient heat insulation and allows for insertion of reinforcement means.

14. The kiln as claimed in claim 13 wherein said insulator block panels comprises light weight fire retardant panels.

15. The kiln as claimed in claim 12 wherein said heat supply comprises a boiler.

16. The kiln as claimed in claim 12 wherein said heat exchanger comprises flat panel stainless steel finned heat exchangers or extruded aluminum fins on carbon steel.

17. The kiln as claimed in claim 12 further comprising a ventilator that operatively functions with said humidifier to achieve the required air condition within said main chamber.

18. The kiln as claimed in claim 17 wherein said ventilator comprises a series of paired inlet and outlet vents located on top or at the sides of said main chamber.

19. The kiln as claimed in claim 12 wherein said air stream generator comprises a motor and fan assembly, the motor being located inside or outside said main chamber, and the fan being located in the upper portion of said main chamber, said assembly enabling the generation of an air stream having an average velocity of between about 2.5 to about 3.5 $ms^{-1}$.

20. The kiln as claimed in claim 12 wherein said controller comprises a set of industrial programmable logic controller (PLC) instrumentation.

21. The kiln as claimed in claim 12 wherein said integral conditioning chamber is of identical technical specifications as the main chamber.

* * * * *